US010184342B2

(12) United States Patent
Zhang et al.

(10) Patent No.: US 10,184,342 B2
(45) Date of Patent: Jan. 22, 2019

(54) SYSTEM FOR COOLING SEAL RAILS OF TIP SHROUD OF TURBINE BLADE

(71) Applicant: General Electric Company, Schenectady, NY (US)

(72) Inventors: Xiuzhang James Zhang, Simpsonville, SC (US); James Tyson Balkcum, III, Taylors, SC (US); Ian Darnall Reeves, Piedmont, SC (US); Joseph Anthony Cotroneo, Clifton Park, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 460 days.

(21) Appl. No.: 15/099,116

(22) Filed: Apr. 14, 2016

(65) Prior Publication Data

US 2017/0298744 A1 Oct. 19, 2017

(51) Int. Cl.

*F01D 5/18* (2006.01)
*F01D 5/20* (2006.01)
*F01D 5/22* (2006.01)

(52) U.S. Cl.

CPC ..... *F01D 5/187* (2013.01); *F01D 5/18* (2013.01); *F01D 5/20* (2013.01); *F01D 5/225* (2013.01);

(Continued)

(58) Field of Classification Search

CPC ... F01D 5/18; F01D 5/187; F01D 5/20; F01D 5/225; F05D 2220/32; F05D 2240/307; F05D 2240/55; F05D 2260/20

See application file for complete search history.

(56) References Cited

U.S. PATENT DOCUMENTS 4,390,320 A 6/1983 Eiswerth
4,940,388 A * 7/1990 Lilleker ..... F01D 5/187 416/97 R (Continued)

FOREIGN PATENT DOCUMENTS

EP 1 865 149 A2 12/2007
EP 2 149 675 A2 2/2010

(Continued)

OTHER PUBLICATIONS

U.S. Appl. No. 14/974,155, filed Dec. 15, 2015, Rohit Chouhan et al.

(Continued)

*Primary Examiner* — Igor Kershteyn
(74) *Attorney, Agent, or Firm* — Fletcher Yoder, P.C.

(57) ABSTRACT

A turbine blade includes a tip shroud having a seal rail. The seal rail includes a tangential surface extending between tangential ends. The turbine blade includes a root portion configured to couple to a rotor and an airfoil portion extending between the root portion and the tip shroud. The seal rail includes a cooling passage extending along a length of the seal rail. The cooling passage is fluidly coupled to a cooling plenum to receive a cooling fluid via an intermediate cooling passage extending between the cooling passage and a cooling plenum. The seal rail includes cooling outlet passages fluidly coupled to the cooling passage. The cooling outlet passages are disposed within the seal rail and extend between the cooling passage and the tangential surface of the seal rail. The cooling outlet passages are configured to discharge the cooling fluid from the tip shroud via the tangential surface.

20 Claims, 8 Drawing Sheets

(52) U.S. Cl.
CPC .... *F05D 2220/32* (2013.01); *F05D 2240/307* (2013.01); *F05D 2240/55* (2013.01); *F05D 2260/20* (2013.01)

(56) References Cited

U.S. PATENT DOCUMENTS 5,460,486 A * 10/1995 Evans ..... F01D 5/187 415/115
5,482,435 A 1/1996 Dorris et al.
5,531,568 A * 7/1996 Broadhead ..... F01D 5/186 415/115
5,660,523 A 8/1997 Lee
5,785,496 A * 7/1998 Tomita ..... F01D 5/187 416/191
6,086,328 A 7/2000 Lee
6,099,253 A 8/2000 Fukue et al.
6,190,129 B1 2/2001 Mayer et al.
6,241,471 B1 6/2001 Herron
6,254,345 B1 * 7/2001 Harris ..... F01D 5/18 416/189
6,422,821 B1 7/2002 Lee et al.
6,471,480 B1 10/2002 Balkcum, III et al.
6,506,022 B2 * 1/2003 Bunker ..... F01D 5/187 416/191
6,595,749 B2 7/2003 Lee et al.
6,641,360 B2 * 11/2003 Beeck ..... F01D 5/186 415/1
6,672,829 B1 1/2004 Cherry et al.
7,273,347 B2 * 9/2007 Rathmann ..... F01D 5/186 415/173.6
7,473,073 B1 1/2009 Liang
7,494,319 B1 2/2009 Liang
7,568,882 B2 8/2009 Brittingham et al.
7,607,893 B2 10/2009 Lee et al.
7,628,587 B2 * 12/2009 McFeat ..... F01D 5/141 415/173.1
7,976,280 B2 7/2011 Brittingham et al.
8,075,268 B1 12/2011 Liang
8,096,767 B1 * 1/2012 Liang ..... F01D 5/187 415/115
8,113,779 B1 2/2012 Liang
8,967,972 B2 3/2015 Brandl et al.
2001/0048878 A1 12/2001 Willett et al.
2009/0180895 A1 7/2009 Brittingham
2009/0304520 A1 * 12/2009 Brittingham ..... F01D 5/187 416/97 R
2010/0024216 A1 * 2/2010 DeSander ..... F01D 5/187 29/889.721
2017/0175535 A1 * 6/2017 Chouhan ..... F01D 5/18

FOREIGN PATENT DOCUMENTS

EP 2 607 629 A1 6/2013
GB 1 605 335 A 12/1991

OTHER PUBLICATIONS

Ghaffari, Pouya, et al.; "Impact of Passive Tip-Injection on Tip-Leakage Flow in Axial Low Pressure Turbine Stage", Proceedings of ASME Turbo Expo 2015: Turbine Technical Conference and Exposition GT2015, Jun. 15-19, 2015, Montreal, Canada.
Extended European Search Report and Opinion issued in connection with corresponding EP Application No. 17166058.2 dated Nov. 23, 2017.

* cited by examiner

SYSTEM FOR COOLING SEAL RAILS OF TIP SHROUD OF TURBINE BLADE

BACKGROUND

The subject matter disclosed herein relates to turbines and, more specifically, to turbine blades of a turbine.

A gas turbine engine combusts a fuel to generate hot combustion gases, which flow through a turbine to drive a load and/or a compressor. The turbine includes one or more stages, where each stage includes multiple turbine blades or buckets. Each turbine blade includes an airfoil portion having a radially inward end coupled to a root portion coupled to a rotor and a radially outward portion coupled to a tip portion Some turbine blades include a shroud (e.g., tip shroud) at the tip portion to increase performance of the gas turbine engine. However, the tip shrouds are subject to creep damage over time due to the combination of high temperatures and centrifugally induced bending stresses. Typical cooling systems for cooling the tip shrouds to reduce creep damage may not effectively cool each portion of the tip shroud (e.g., seal rails or teeth).

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In accordance with a first embodiment, a gas turbine engine is provided. The gas turbine engine includes a turbine section. The turbine section includes turbine stage having multiple turbine blades coupled to a rotor. At least one turbine blade of the multiple turbine blades includes a tip shroud portion having a base portion and a first seal rail extending radially from the base portion. The first seal rail includes a tangential surface extending between tangential ends. The at least one turbine blade also includes a root portion coupled to the rotor. The at least one turbine blade further includes an airfoil portion extending between the root portion and the tip shroud portion. The airfoil portion includes a first cooling plenum extending radially through the airfoil portion and configured to receive a cooling fluid. The first cooling plenum is axially offset from the seal rail relative to a rotational axis of the rotor. The first seal rail includes a first cooling passage extending along a first length of the first seal rail. The first cooling passage is fluidly coupled to the first cooling plenum to receive the cooling fluid via a first intermediate cooling passage extending between the first cooling passage and the first cooling plenum. The first seal rail includes a first multiple of cooling outlet passages fluidly coupled to the first cooling passage to receive the cooling fluid. The first multiple of cooling outlet passages are disposed within the first seal rail and extending between the first cooling passage and the tangential surface of the first seal rail. The first multiple of cooling outlet passages are configured to discharge the cooling fluid from the tip shroud portion via the tangential surface.

In accordance with a second embodiment, a turbine is provided. The turbine includes a rotor and a turbine having multiple turbine blades coupled to the rotor. At least one turbine blade of the multiple turbine blades includes a tip shroud portion having a base portion and a seal rail extending radially from the base portion. The seal rail includes a tangential surface extending between tangential ends. The at least one turbine blade also includes a root portion coupled to the rotor. The at least one turbine blade further includes an airfoil portion extending between the root portion and the tip shroud portion. The airfoil portion includes a cooling plenum extending radially through the airfoil portion and configured to receive a cooling fluid. The cooling plenum is axially offset from the seal rail relative to a rotational axis of the rotor. The seal rail includes a cooling passage extending along a length of the seal rail. The cooling passage is fluidly coupled to the cooling plenum to receive the cooling fluid via an intermediate cooling passage extending between the cooling passage and the cooling plenum. The seal rail includes a multiple of cooling outlet passages fluidly coupled to the cooling passage to receive the cooling fluid. The multiple of cooling outlet passages are disposed within the seal rail and extending between the cooling passage and the tangential surface of the seal rail. The multiple of cooling outlet passages are configured to discharge the cooling fluid from the tip shroud portion via the tangential surface.

In accordance with a third embodiment, a turbine blade is provided. The turbine blade includes a tip shroud portion having a base portion and a seal rail extending radially from the base portion. The seal rail includes a tangential surface extending between tangential ends. The turbine blade also includes a root portion configured to couple to a rotor of a turbine. The turbine blade further includes an airfoil portion extending between the root portion and the tip shroud portion. The airfoil portion includes a cooling plenum extending radially through the airfoil portion and configured to receive a cooling fluid. The cooling plenum is axially offset from the seal rail relative to a rotational axis of the rotor. The seal rail includes a cooling passage extending along a length of the seal rail. The cooling passage is fluidly coupled to the cooling plenum to receive the cooling fluid via an intermediate cooling passage extending between the cooling passage and the cooling plenum. The seal rail includes a multiple of cooling outlet passages fluidly coupled to the cooling passage to receive the cooling fluid. The multiple of cooling outlet passages are disposed within the seal rail and extending between the cooling passage and the tangential surface of the seal rail. The multiple of cooling outlet passages are configured to discharge the cooling fluid from the tip shroud portion via the tangential surface.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

Figure 1:
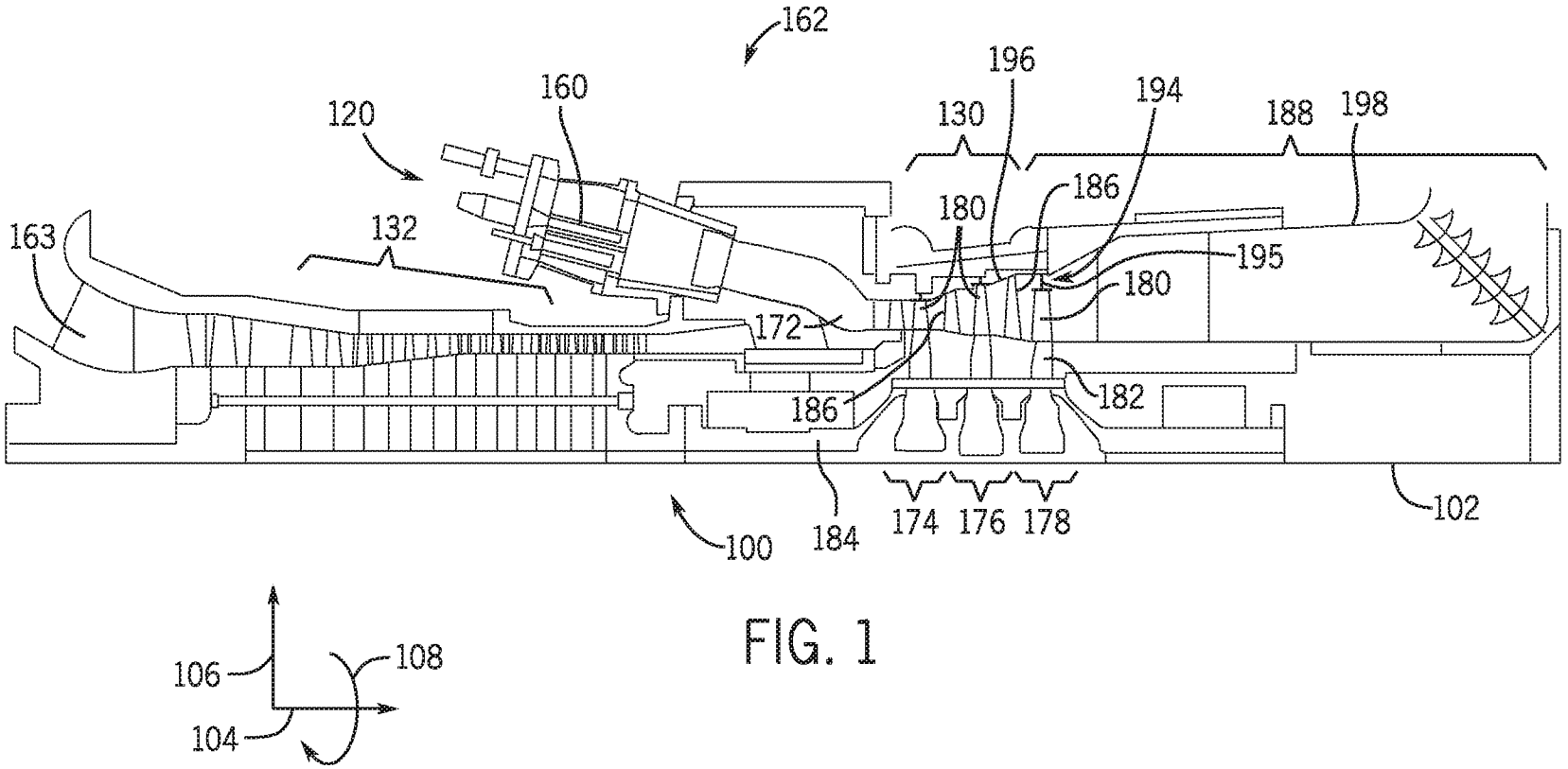
FIG. 1 is a cross-sectional side view of a gas turbine engine sectioned through a longitudinal axis.

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

The disclosed embodiments are directed towards a cooling system for cooling tip shrouds of turbine blades or buckets. As disclosed below, the disclosed cooling system enables cooling of one or more seal rails or teeth of the tip shroud. For example, a turbine blade includes one or more seal rails each including one or more cooling passages extending within the seal rails along a respective length (e.g., longitudinal length or largest dimension) of the seal rail. The turbine blade includes one or more cooling plenums (e.g., axially offset from the seal rail) extending radially through the blade (e.g., in airfoil portion in a direction from a root portion to the tip shroud portion). The cooling passage is fluidly coupled to the cooling plenum via an intermediate cooling passage that extends between the cooling passage and the cooling plenum. The cooling passage includes a plurality of cooling outlet passages that extend from the cooling passage to a tangential surface (e.g., top surface or side surfaces extending between tangential ends of the seal rail) of the seal rail. The cooling plenum is configured to receive a cooling fluid (e.g., air from a compressor) that subsequently flows (via cooling fluid flow path) into the intermediate cooling passage to the cooling passage and to the cooling outlet passages for discharge from the tangential surface (e.g., top surface) of the seal rail. In certain embodiments, the discharge of the cooling fluid from the top surface of the seal rail blocks or reduces (e.g., via a seal) over tip leakage fluid flow (e.g., of the exhaust) between the top surface and a stationary shroud disposed radially across from the top surface. In other embodiments, the discharge of the cooling fluid from the top surface of the seal rail increases torque of the turbine blade as it rotates about the rotor. The cooling fluid flowing along the cooling fluid flow path reduces the temperature (e.g., metal temperature) of the shroud tip (specifically, the one or more seal rails) of the turbine blade. The reduced temperature along the seal rail adds structural strength to the tip shroud increasing the durability of the turbine blade as a whole. The reduced temperature along the seal rail also increases fillet creep capability of the tip shroud.

FIG. 1 is a cross-sectional side view of an embodiment of a gas turbine engine 100 sectioned through a longitudinal axis 102 (also representative of a rotational axis of the turbine or rotor). In describing, the gas turbine engine 100 reference may be made to an axial axis or direction 104, a radial direction 106 toward or away from the axis 104, and a circumferential or tangential direction 108 around the axis 104. As appreciated, the tip shroud cooling system may be used in any turbine system, such as gas turbine systems and steam turbine systems, and is not intended to be limited to any particular machine or system. As described further below, a cooling system may be utilized to cool one or more seal rails or teeth of a tip shroud of a turbine blade. For example, a cooling fluid flow path may extend through each turbine blade (e.g., through a blade or airfoil portion and tip shroud portion) that enables a cooling fluid (e.g., air from a compressor) to flow through and out of the one or more seal rails to reduce the temperature of the one or more seal rails. The reduced temperature along the seal rail adds structural strength to the tip shroud increasing the durability of the turbine blade as a whole. The reduced temperature along the seal rail also increases fillet creep capability of the tip shroud.

The gas turbine engine 100 includes one or more fuel nozzles 160 located inside a combustor section 162. In certain embodiments, the gas turbine engine 100 may include multiple combustors 120 disposed in an annular arrangement within the combustor section 162. Further, each combustor 120 may include multiple fuel nozzles 160 attached to or near the head end of each combustor 120 in an annular or other arrangement.

Air enters through the air intake section 163 and is compressed by the compressor 132. The compressed air from the compressor 132 is then directed into the combustor section 162 where the compressed air is mixed with fuel. The mixture of compressed air and fuel is generally burned within the combustor section 162 to generate high-temperature, high-pressure combustion gases, which are used to generate torque within the turbine section 130. As noted above, multiple combustors 120 may be annularly disposed within the combustor section 162. Each combustor 120 includes a transition piece 172 that directs the hot combustion gases from the combustor 120 to the turbine section 130. In particular, each transition piece 172 generally defines a hot gas path from the combustor 120 to a nozzle assembly of the turbine section 130, included within a first stage 174 of the turbine 130.

As depicted, the turbine section 130 includes three separate stages 174, 176, and 178 (although the turbine section 130 may include any number of stages). Each stage 174, 176, and 178 includes a plurality of blades 180 (e.g., turbine blades) coupled to a rotor wheel 182 rotatably attached to a shaft 184 (e.g., rotor). Each stage 174, 176, and 178 also includes a nozzle assembly 186 disposed directly upstream of each set of blades 180. The nozzle assemblies 186 direct the hot combustion gases toward the blades 180 where the hot combustion gases apply motive forces to the blades 180 to rotate the blades 180, thereby turning the shaft 184. The hot combustion gases flow through each of the stages 174, 176, and 178 applying motive forces to the blades 180 within each stage 174, 176, and 178. The hot combustion gases may then exit the gas turbine section 130 through an exhaust diffuser section 188.

In the illustrated embodiment, each blade 180 of each stage 174, 176, 178 includes a tip shroud portion 194 that includes one or more seal rails 195 that extend radially 106 from the tip shroud portion 194. The one or more seal rails 195 extend radially 106 towards a stationary shroud 196 disposed about the plurality of blades 180. In certain embodiments, only the blades 180 of a single stage (e.g., the last stage 178) may include the tip shroud portions 194.

Figure 2:
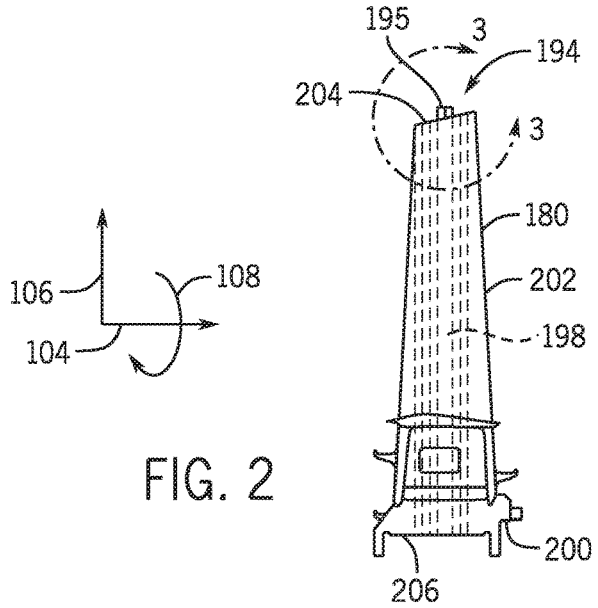
FIG. 2 is a side view of a turbine blade having a plurality of cooling plenums.

FIG. 2 is a side view of the turbine blade 180 having a plurality of cooling plenums 198. The turbine blade 180 includes the tip shroud portion 194, a root portion 200 configured to couple to the rotor (e.g., rotor wheel 182), and an airfoil portion 202. The tip shroud portion 194 includes a base portion 204 that extends both circumferentially 108 and axially 104 relative to the longitudinal axis 102 or the rotational axis. The tip shroud portion 194, as depicted, includes a single seal rail 195 extending radially 106 (e.g., away from the longitudinal axis 102 or the rotational axis) from the base portion 204. In certain embodiments, the tip shroud portion 194 may include more than one seal rail 195. The blade 180 includes the plurality of cooling plenums 198 extending vertically (e.g., radially 106) between the rotor portion 200 and the tip shroud portion 194. The number of cooling plenums 198 may vary between 1 and 20 or any other number. The cooling plenums 198 are axially 104 offset (e.g., relative to the longitudinal or rotational axis 102) from the seal rail 195. Each cooling plenum 198 is configured to receive a cooling fluid (e.g., air from the compressor 132). As described in greater detail below, the tip shroud portion 194 includes one or more cooling passages and cooling outlet passages coupled (e.g., fluidly coupled via one or more intermediate cooling passages) to one or more cooling plenums 198 to define a cooling fluid flow path throughout the blade 180 including the tip shroud portion 194. For example, the cooling fluid flows into the one or more cooling plenums 198 (e.g., through a bottom surface 206 of the root portion 200) into the one or more cooling passages and then into the one or more cooling outlet passages where the cooling fluid is discharged from the seal rail 195 to reduce the temperature of the seal rail 195.

Figure 3:
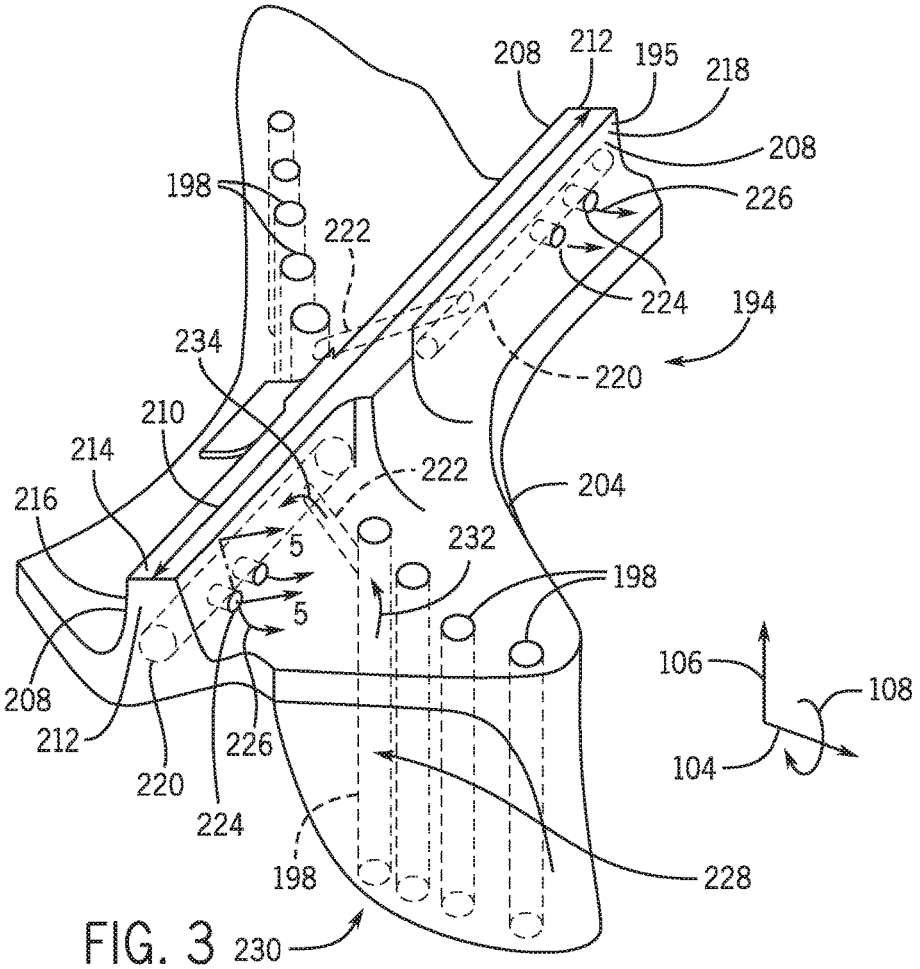
FIG. 3 is a top perspective view of the tip shroud portion of the turbine blade taken within line 3-3 of FIG. 2.

FIG. 3 is a top perspective view of the tip shroud portion 194 of the turbine blade 180 taken within line 3-3 of FIG. 2. The seal rail 195 of the tip shroud portion 194 extends both circumferentially 108 (e.g., tangentially) and axially 104 (e.g., relative to the longitudinal or rotational axis 102). The seal rail 195 includes a tangential surface 208 and a length 210 (e.g., longitudinal length) extending between tangential ends 212. The tangential surface 208 of the seal rail 195 includes a top surface 214 (e.g., most radially 106 outward surface of the seal rail 195) and side surfaces 216, 218 radially 106 extending between the base portion 204 and the top surface 214. The side surfaces 216, 218 are disposed opposite each other. For example, one of the side surfaces 216, 218 may be a forward or upstream surface (e.g., oriented towards the compressor 132), while the other side surface 216, 218 may be an aft or downstream surface (e.g., oriented towards the exhaust section 188).

Figure 4:
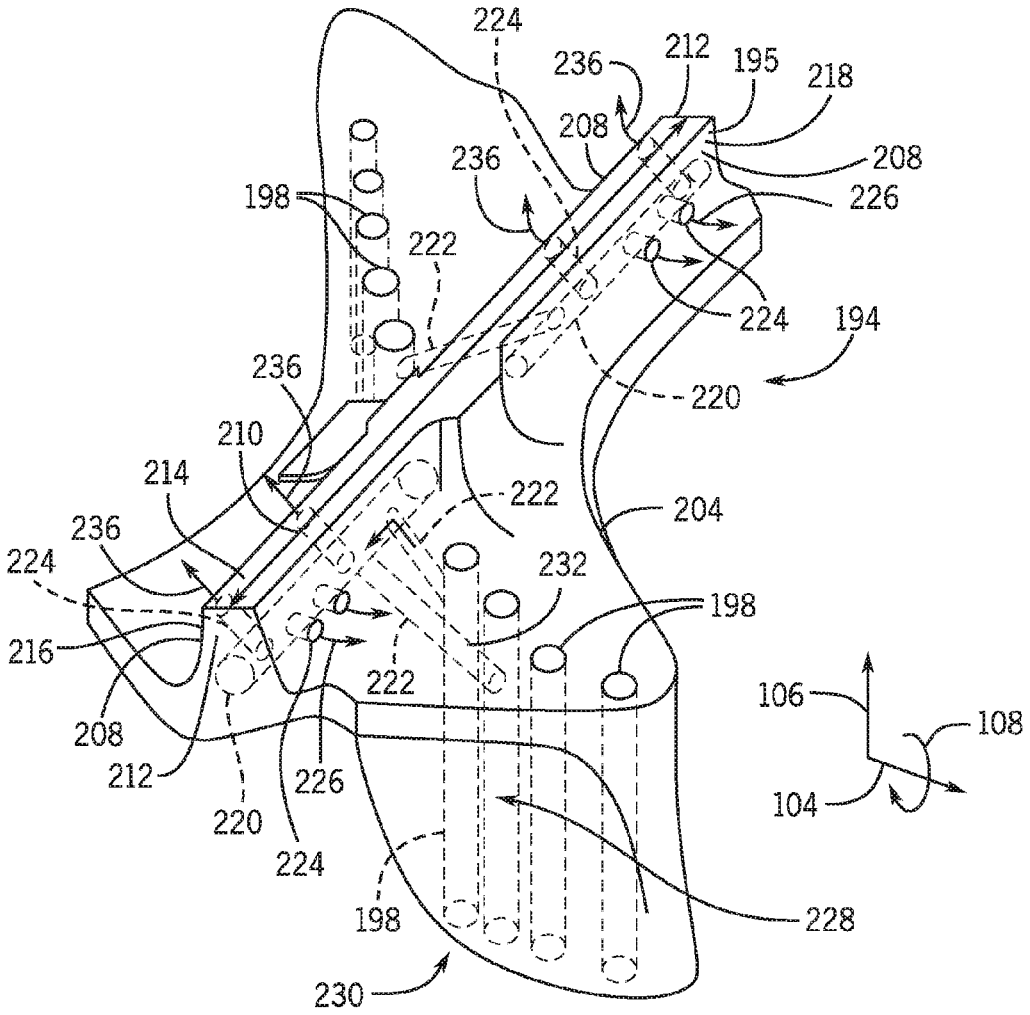
FIG. 4 is a top perspective view of the tip shroud portion of the turbine blade taken within line 3-3 of FIG. 2 (e.g., having discharge of cooling flow from multiple side surfaces of a seal rail)

As depicted, the tip shroud portion 194 includes a plurality of cooling passages 220 disposed within the seal rail 195 that each extend along a portion (less than an entirety) of the length 210 of the seal rail 195. In certain embodiments, the cooling passage 220 may extend between approximately 1 to 100 percent of the length 210. For example, the cooling passage 220 may extend between 1 to 25, 25 to 50, 50 to 75, 75 to 100 percent, and all subranges therein of the length 210. As depicted, each cooling passage 220 is coupled (e.g., fluidly coupled) to a respective cooling plenum 198 to receive the cooling fluid. The cooling plenum 198 is as described in FIG. 2. Specifically, a respective intermediate cooling passage 222 extends (e.g., axially 104 and/or radially 106) between the respective cooling plenum 198 (e.g., axially 104 offset from the seal rail 195) and the respective cooling passage 220 to couple (e.g., fluidly couple) the plenum 198 to the passage 220. In certain embodiments, each cooling passage 220 may be coupled to more than one cooling plenum 198 (see FIG. 4). In certain embodiments, a respective cooling plenum 198 may be coupled to more than one cooling passage 220. Each cooling passage 220 is coupled (e.g., fluidly coupled) to a plurality of cooling outlet passages 224 (2 to 20 or more outlet passages 224). The plurality of cooling outlet passages 224 extend from the cooling passage 220 to the tangential surface 208 (e.g., top surface 214, sides surfaces 216, 218). As depicted, the plurality of cooling outlet passages 224 extends to the side surface 218. In certain embodiments, the plurality of cooling outlet passages 224 extends to the side surface 216. In other embodiments, the plurality of cooling outlet passages 224 extends to both of the side surfaces 216, 218 (see FIG. 4 indicating cooling fluid discharge 236 from the side surface 216). In some embodiments, the plurality of cooling outlet passages 224 extends to top surface (see FIGS. 8 and 9). In certain embodiments, the plurality of cooling outlet passages 224 extends to the top surface and one or more of the side surfaces 216, 218. The plurality of cooling outlet passages 224 discharges the cooling fluid from the tangential surface 208 of the seal rail 195 as indicated by arrows 226. As result, cooling fluid flows along a cooling fluid flow path 228 through the cooling plenum 198 (as indicated by arrow 230) into the intermediate cooling passage 222 (as indicated by arrow 232) and then into the cooling passage 220 (as indicated by arrow 234) prior to discharge from the seal rail 195. Flow of the cooling fluid along the cooling fluid flow path 228 enables the reduction in temperature of the tip rail portion 194 and, in particular, the seal rail 195.

Figure 5:
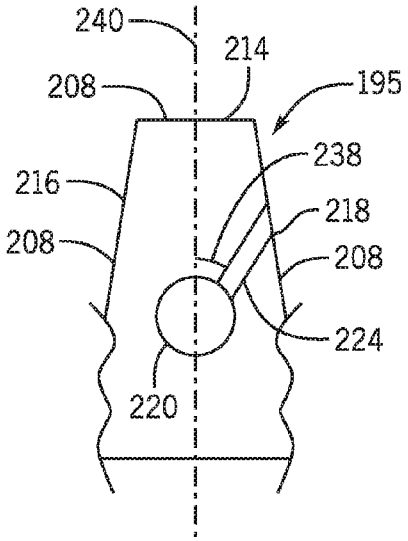
FIG. 5 is a cross-sectional side view of a seal rail of the tip shroud portion of the turbine blade taken along line 5-5 of FIG. 3.
Figure 5:
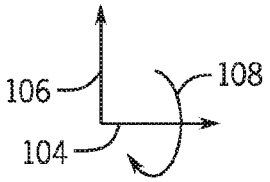

FIG. 5 is a cross-sectional side view of the seal rail 195 of the tip shroud portion 194 of the turbine blade 180 taken along line 5-5 of FIG. 3. The seal rail 195 includes the cooling passages 220 and the cooling outlet passages 224 as described in FIG. 3. As depicted, the cooling outlet passage 224 extends between the cooling passage 220 and the side surface 218 at an angle 238 relative to a radial plane 240 (e.g., through the center of the seal rail 195) extending radially 106 through the seal rail 195 along the length 210. The angle 238 may range from greater than 0 degree to less than 180 degrees. The angle 238 may range from greater than 0 degree to 30 degrees, 30 to 60 degrees, 60 to 90 degrees, 90 to 120 degrees, 120 to 150 degrees, 150 to less than 180 degrees, and all subranges therein. For example, the angle 238 may be approximately 10, 20, 30, 40, 50, 60, 70, 80, 90, 100, 110, 120, 130, 140, 150, 160, or 170 degrees. In certain embodiments, the cooling outlet passage 224 extends between the cooling passage 220 and the side surface 218 at the angle 238 relative to the radial plane 240.

Figure 6:
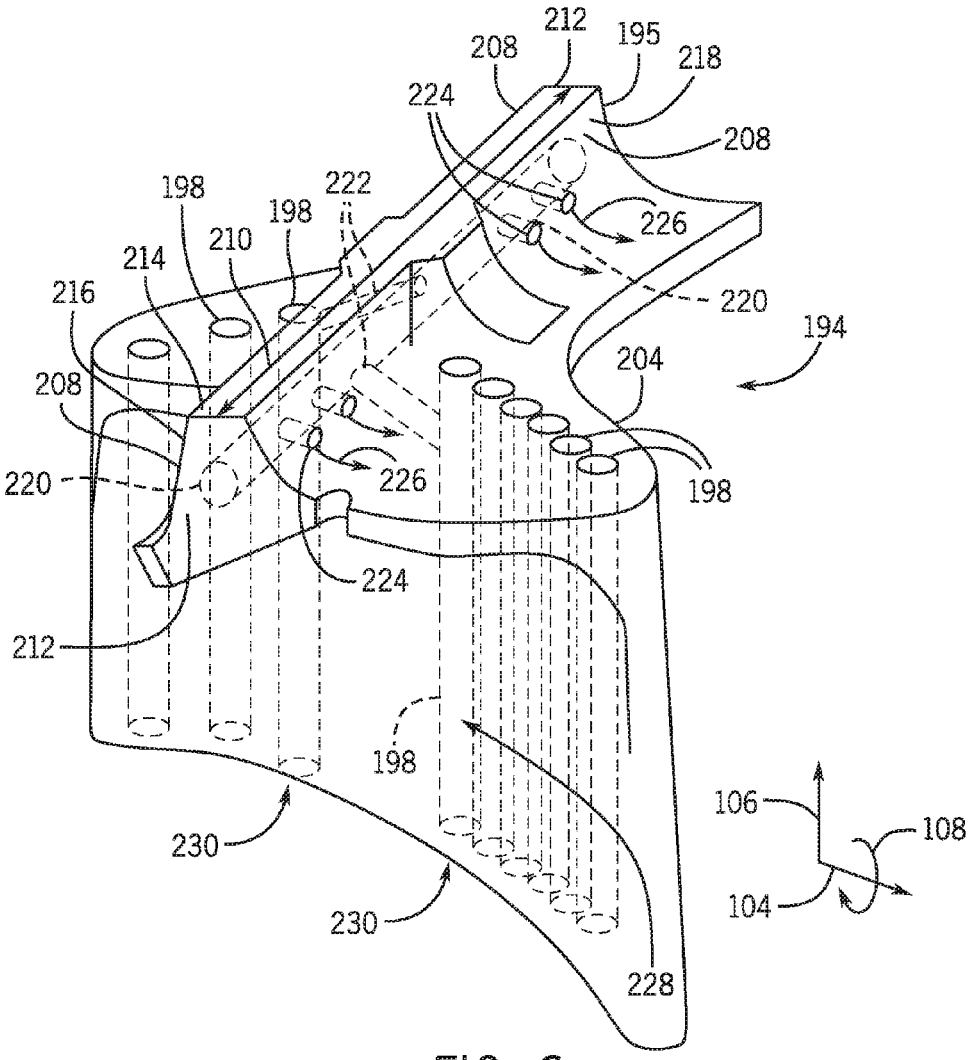
FIG. 6 is a top perspective view of the tip shroud portion of the turbine blade taken within line 3-3 of FIG. 3 (e.g., having a single cooling passage along a length (e.g., longitudinal) of a seal rail)
Figure 7:
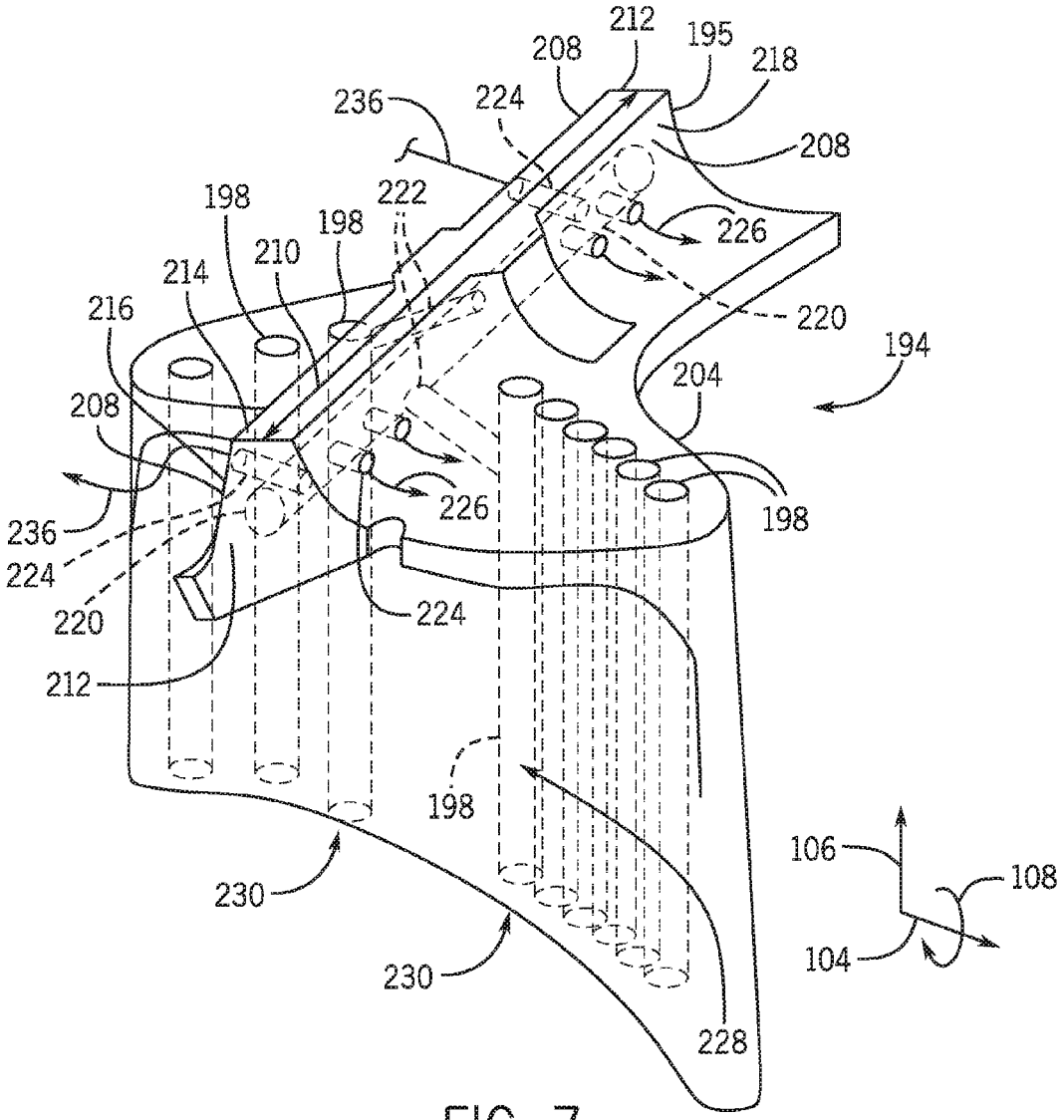
FIG. 7 is a top perspective view of the tip shroud portion of the turbine blade taken within line 3-3 of FIG. 3 (e.g., having a single cooling passage along a length (e.g., longitudinal length) of a seal rail with discharge of cooling flow from multiple side surfaces of the seal rail)

FIG. 6 is a top perspective view of the tip shroud portion 194 of the turbine blade 180 taken within line 3-3 of FIG. 3 (e.g., having a single cooling passage 220 along the length 210 of the seal rail 195). In general, the tip shroud portion 194 is as described in FIG. 4 except the seal rail 195 includes the single cooling passage 220. The single cooling passage 220 extends (e.g., an entirety of) the length 210 of the seal rail 195. In certain embodiments, the single cooing passage 220 extends along a portion (e.g., less than an entirety) of the length 210. In certain embodiments, the single cooling passage 220 may extend between approximately 1 to 100 percent of the length 210. For example, the single cooling passage 220 may extend between 1 to 25, 25 to 50, 50 to 75, 75 to 100 percent, and all subranges therein of the longitudinal length 210. As depicted, the cooling passage 220 is coupled to a plurality of the cooling plenums 198. In addition, the cooling outlet passages 224 extend from the cooling passage 220 to the side surface 218. The cooling outlet passages 224 discharge the cooling fluid from the side surface 218 as indicated by arrows 226. In certain embodiments, the cooling outlet passages 224 extend from the cooling passage 220 to the side surface 216. In other embodiments, the cooling outlet passages 224 extend from the cooling passage both of the side surfaces 216, 218 for discharge of the cooling fluid 226, 236 (see FIG. 7).

Figure 8:
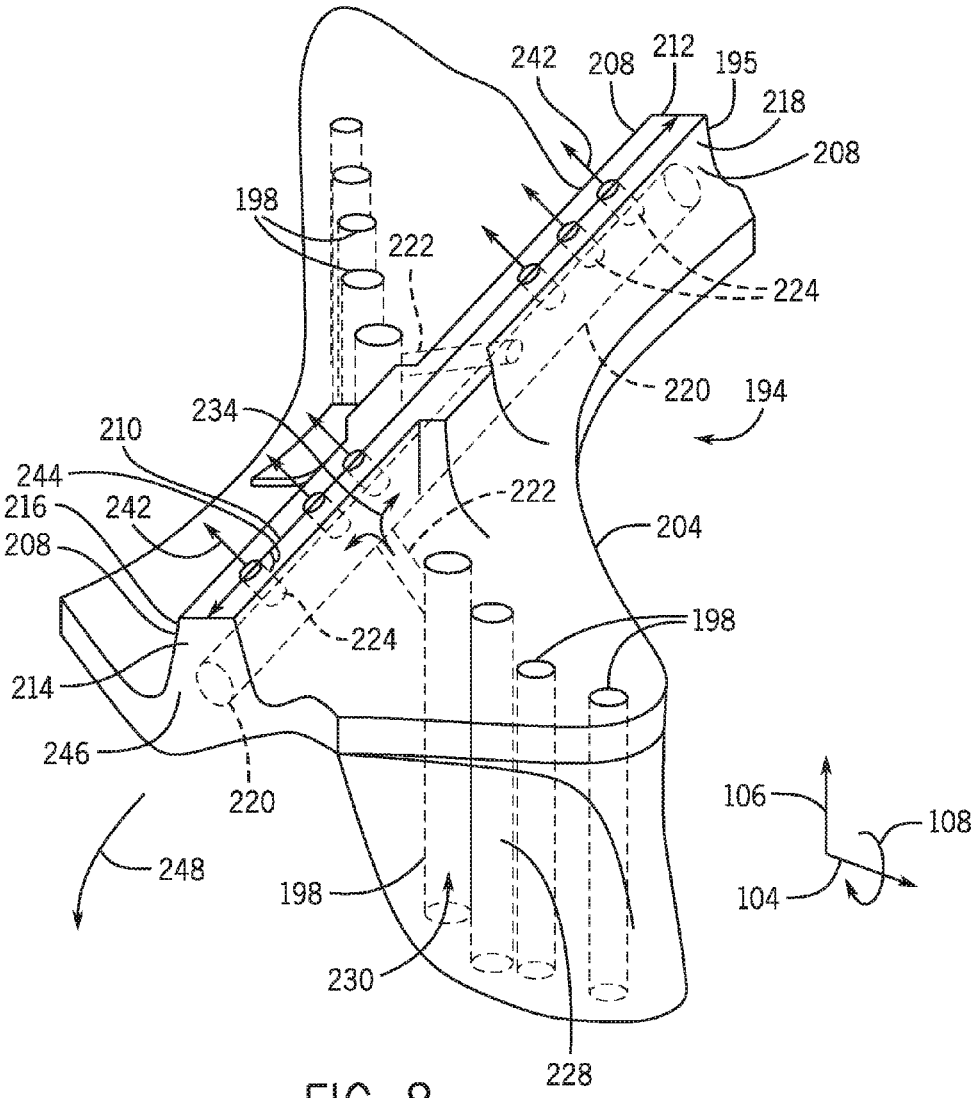
FIG. 8 is a top perspective view of the tip shroud portion of the turbine blade taken along line 3-3 of FIG. 2 (e.g., having discharge of cooling flow from a top surface of a seal rail in a direction of rotation)

FIG. 8 is a top perspective view of the tip shroud portion 194 of the turbine blade 180 taken along line 3-3 of FIG. 2 (e.g., having discharge of cooling flow from the top surface 214 of the seal rail 195 in a direction of rotation). Generally, the tip shroud portion 194 depicted in FIG. 8 is as described above in FIG. 6. However, the cooling outlet passages 224 extend from the cooling passage 220 to the top surface 214 to enable discharge of cooling fluid 242. The cooling outlet passages 224 may discharge the cooling fluid 242 along an entirety or less than an entirety of the length 210 of the seal rail 195. In certain embodiments, the cooling outlet passages 224 may discharge the cooling fluid 242 along a majority of the length 210 (e.g., to block or reduce over tip leakage flow). In certain embodiments, the cooling outlet passages 224 may also extend from the cooling passage 220 to one or more of the side surfaces 216, 218. In certain embodiments, the tip shroud portion 194 may include more than one cooling passage 220 coupled to one or more of the cooling plenums 198 via one or more of the intermediate cooling passages 222.

As depicted, the cooling outlet passages 224 are angled at an angle 244 relative to the length 210 of the seal rail 195. In certain embodiments, the angle 244 may range from greater than 0 degree to less than 180 degrees. The angle 244 may range from greater than 0 degree to 30 degrees, 30 to 60 degrees, 60 to 90 degrees, 90 to 120 degrees, 120 to 150 degrees, 150 to less than 180 degrees, and all subranges therein. For example, the angle 238 may be approximately 10, 20, 30, 40, 50, 60, 70, 80, 90, 100, 110, 120, 130, 140, 150, 160, or 170 degrees. As depicted, the cooling outlet passages 224 are angled toward towards the tangential end 212 (e.g., tangential end 246) in a direction of rotation 248 of the blade 180. The discharge of the cooling flow 242 by the cooling outlet passages 224 from the top surface 214 reduces or blocks (e.g., via a seal) over tip leakage flow (e.g., exhaust flow) between the top surface 214 and an innermost surface of the stationary shroud 196 disposed radially 106 across from the top surface 214 (see FIG. 1).

Figure 9:
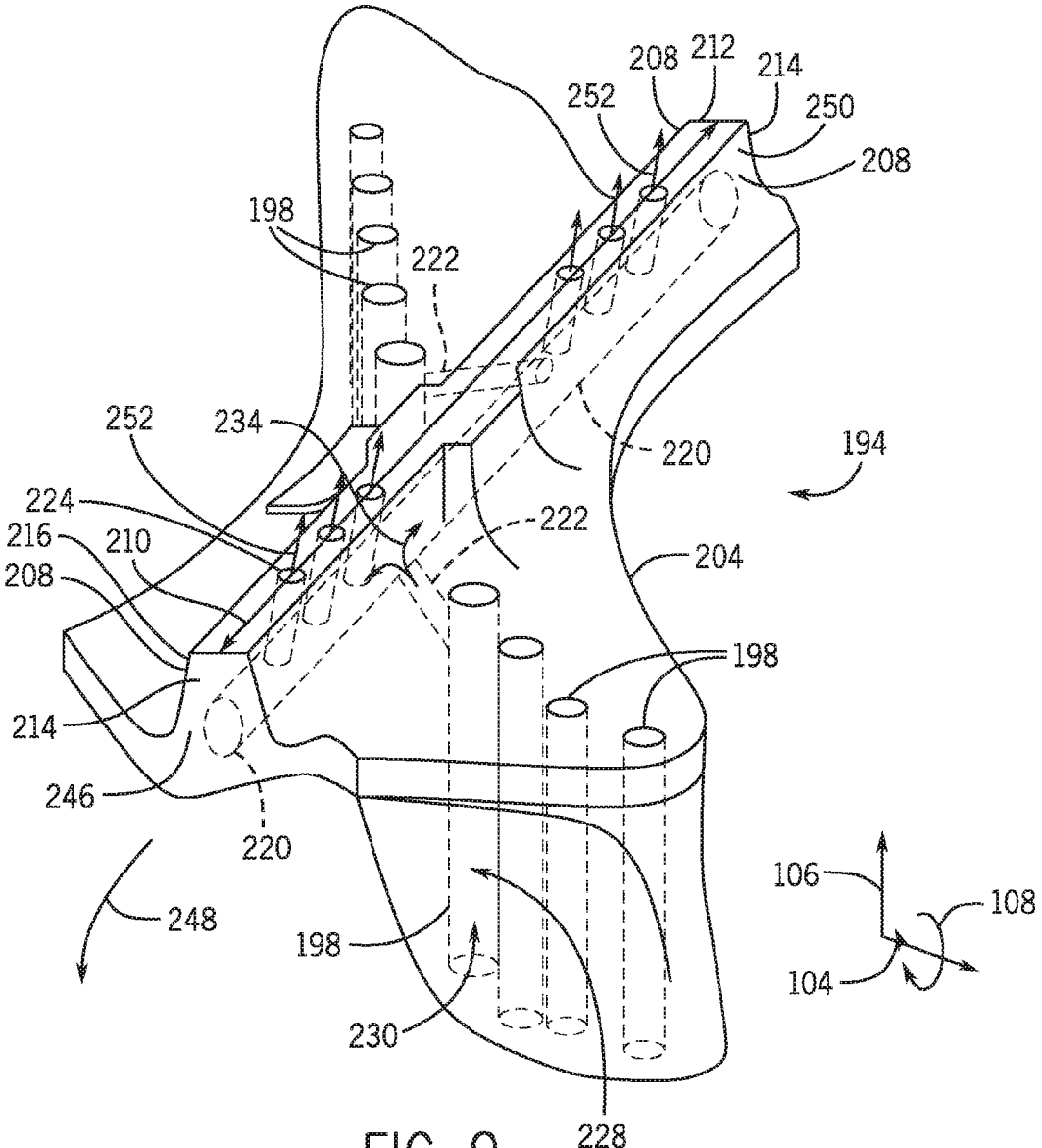
FIG. 9 is a top perspective view of the tip shroud portion of the turbine blade taken along line 3-3 of FIG. 2 (e.g., having discharge of cooling flow from a top surface of a seal rail away from a direction of rotation)

FIG. 9 is a top perspective view of the tip shroud portion 194 of the turbine blade 180 taken along line 3-3 of FIG. 2 (e.g., having discharge of cooling flow from the top surface 214 of the seal rail 195 away from a direction of rotation). Generally, the tip shroud portion 194 depicted in FIG. 9 is as described above in FIG. 8 except the cooling outlet passages 224 are angled toward towards the tangential end 212 (e.g., tangential end 250) away from the direction of rotation 248 of the blade 180. The discharge of the cooling flow 252 by the cooling outlet passages 224 from the top surface 214 reduces or blocks over tip leakage flow (e.g., exhaust flow) between the top surface 214 and an innermost surface of the stationary shroud 196 disposed radially 106 across from the top surface 214 (see FIG. 1). In addition, the discharge of the cooling flow 252 in the direction opposite from the direction of rotation 248 increases a torque (and, thus, horsepower of the turbine engine 100) of the respective turbine blade 180 as it rotates about the rotational axis 104 of the rotor.

Figure 10:
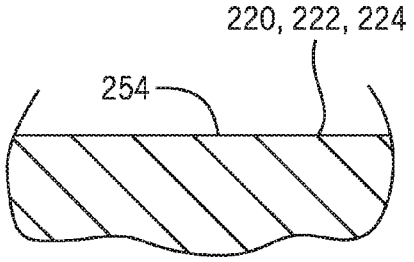
FIG. 10 is a cross-sectional side view of a portion of a cooling passage (e.g., smooth)
Figure 11:
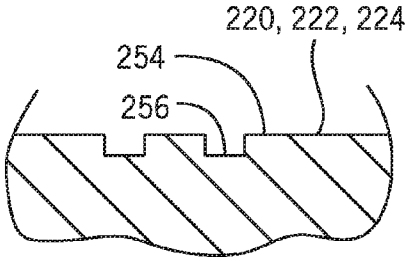
FIG. 11 is a cross-sectional side view of a portion of a cooling passage (e.g., having recesses)
Figure 12:
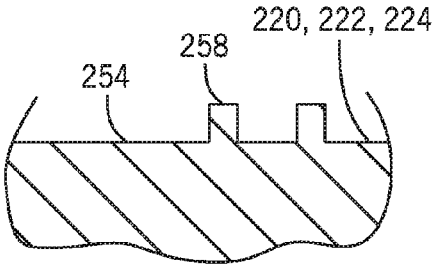
FIG. 12 is a cross-sectional side view of a portion of a cooling passage (e.g., having protrusions).

In certain embodiments, an inner surface 254 of the cooling passages 220, the intermediate cooling passages 222, and/or the cooling outlet passages 224 are smooth (see FIG. 10). In certain embodiments, the inner surface 254 of the cooling passages 220, the intermediate cooling passages 222, and/or the cooling outlet passages 224 include recesses 256 (see FIG. 11) to induce or produce turbulence in a flow of the cooling fluid through the respective passage. In certain embodiments, the inner surface 254 of the cooling passages 220, the intermediate cooling passages 222, and/or the cooling outlet passages 224 include protrusions 258 (see FIG. 12) to induce or produce turbulence in a flow of the cooling fluid through the respective passage. In certain embodiments, the inner surface 254 of the cooling passages 220, the intermediate cooling passages 222, and/or the cooling outlet passages 224 include both recesses 256 and protrusions 258 to induce or produce turbulence in a flow of the cooling fluid through the respective passage.

Technical effects of the disclosed embodiments include providing a cooling system for one or more seal rails of turbine blades. The cooling fluid flowing along the cooling fluid flow path reduces the temperature (e.g., metal temperature) of the shroud tip (specifically, the one or more seal rails) of the turbine blade. The reduced temperature along the seal rail adds structural strength to the tip shroud increasing the durability of the turbine blade as a whole. The reduced temperature along the seal rail also increases fillet creep capability of the tip shroud. In certain embodiments, the discharge of the cooling fluid from the top surface of the seal rail blocks or reduces over tip leakage fluid flow (e.g., of the exhaust) between the top surface and a stationary shroud disposed radially across from the top surface. In other embodiments, the discharge of the cooling fluid from the top surface of the seal rail increases torque of the turbine blade as it rotates about the rotor.

This written description uses examples to disclose the subject matter, including the best mode, and also to enable any person skilled in the art to practice the subject matter, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A gas turbine engine, comprising:

a turbine section, wherein the turbine section comprises a turbine stage having a plurality of turbine blades coupled to a rotor, wherein at least one turbine blade of the plurality of turbine blades comprises:

a tip shroud portion having a base portion and a first seal rail extending radially from the base portion, wherein the first seal rail comprises a tangential surface extending between tangential ends;

a root portion coupled to the rotor; and an airfoil portion radially extending between the root portion and the tip shroud portion; and wherein the airfoil portion comprises a first cooling plenum extending radially through the airfoil portion and configured to receive a cooling fluid, and the first cooling plenum is axially offset from the seal rail relative to a rotational axis of the rotor, wherein the first seal rail comprises a first cooling passage extending along a first length of the first seal rail, the first cooling passage is fluidly coupled to the first cooling plenum to receive the cooling fluid via a first intermediate cooling passage extending between the first cooling passage and the first cooling plenum, and wherein the first seal rail comprises a first plurality of cooling outlet passages fluidly coupled to the first cooling passage to receive the cooling fluid, the first plurality of cooling outlet passages being disposed within the first seal rail and extending between the first cooling passage and the tangential surface of the first seal rail, and the first plurality of cooling outlet passages are configured to discharge the cooling fluid from the tip shroud portion via the tangential surface.

2. The gas turbine engine of claim 1, wherein the tangential surface comprises a top surface of the first seal rail extending between the tangential ends, the top surface is the most radially outward surface of the first seal rail relative to the rotational axis of the rotor, and the first plurality of cooling outlet passages are configured to discharge the cooling fluid from the top surface to reduce over tip leakage between the top surface and an innermost surface of a stationary shroud disposed radially across from the top surface.

3. The gas turbine engine of claim 2, wherein the first plurality of cooling outlet passages are angled relative to the first length of the first seal rail at an angle greater than 0 degree and less than 180 degrees.

4. The gas turbine engine of claim 3, wherein the first plurality of cooling outlet passages are angled in a direction of rotation of the plurality of turbine blades about the rotor.

5. The gas turbine engine of claim 3, wherein the first plurality of cooling outlet passages are angled away from a direction of rotation of the plurality of turbine blades about the rotor, and the first plurality of cooling outlet passages are configured to discharge the cooling fluid from the top surface to increase a torque of the respective turbine blade as it rotates about the rotational axis of the rotor.

6. The gas turbine engine of claim 1, wherein the tangential surface comprises a first side surface or a second side surface of the first seal rail extending between the tangential ends of the first seal rail and extending radially between a top surface of the first seal rail and the base portion, and the first side surface is disposed opposite the second side surface.

7. The gas turbine engine of claim 6, wherein the first plurality of cooling outlet passages extends between the first cooling plenum and both the first and second side surfaces.

8. The gas turbine engine of claim 6, wherein the first plurality of cooling outlet passages are angled relative to a radial plane extending through the first seal rail along the first length at an angle greater than 0 degree and less than 180 degrees.

9. The gas turbine engine of claim 1, wherein the first cooling passage extends along an entirety of the first longitudinal length of the first seal rail.

10. The gas turbine engine of claim 1, wherein the first cooling passage extends along less than an entirety of the first length of the first seal rail.

11. The gas turbine engine of claim 1, wherein the airfoil portion comprises a second cooling plenum extending radially through the airfoil portion and configured to receive the cooling fluid, and wherein the first seal rail comprises a second cooling passage extending along the first length of the first seal rail, and the second cooling passage is fluidly coupled to the second cooling plenum to receive the cooling fluid via a second intermediate cooling passage extending between the second cooling passage and the second cooling plenum, and wherein the first seal rail comprises a second plurality of cooling outlet passages being disposed within the first seal rail and extending between the second cooling passage and the tangential surface of the first seal rail, and the plurality of second cooling passages are configured to discharge the cooling fluid from the tip shroud portion via the tangential surface.

12. The gas turbine engine of claim 1, wherein the tip shroud portion comprises a second seal rail extending from the base portion, wherein the airfoil portion comprises a second cooling plenum extending longitudinally through the airfoil portion and configured to receive the cooling fluid, wherein the second seal rail comprises a second cooling passage extending along a second length of the second seal rail, and the second cooling passage is fluidly coupled to the second cooling plenum to receive the cooling fluid via a second intermediate cooling passage extending between the second cooling passage and the second cooling plenum, and wherein the second seal rail comprises a second plurality of cooling outlet passages being disposed within the second seal rail and extending between the second cooling passage and the second seal rail, and the plurality of second cooling outlet passages are configured to discharge the cooling fluid from the tip shroud portion via the second seal rail.

13. The gas turbine engine of claim 1, wherein an inner surface of the first cooling passage is smooth.

14. The gas turbine engine of claim 1, wherein an inner surface of the first cooling passage comprises recesses or protrusions configured to induce turbulence in a flow of the cooling fluid through the first cooling passage.

15. A turbine, comprising:

a rotor;

a turbine stage having a plurality of turbine blades coupled to the rotor, wherein at least one turbine blade of the plurality of turbine blades comprises:

a tip shroud portion having a base portion and a seal rail extending radially from the base portion, wherein the seal rail comprises a tangential surface extending between tangential ends;

a root portion coupled to the rotor; and an airfoil portion radially extending between the root portion and the tip shroud portion; and wherein the airfoil portion comprises a cooling plenum extending radially through the airfoil portion and configured to receive a cooling fluid, and the cooling plenum is axially offset from the seal rail relative to a rotational axis of the rotor, wherein the seal rail comprises a cooling passage extending along a length of the seal rail, the cooling passage is fluidly coupled to the cooling plenum to receive the cooling fluid via an intermediate cooling passage extending between the cooling passage and the cooling plenum, and wherein the seal rail comprises a plurality of cooling outlet passages fluidly coupled to the cooling passage to receive the cooling fluid, the plurality of cooling outlet passages being disposed within the seal rail and extending between the cooling passage and the tangential surface of the seal rail, and the plurality of cooling outlet passages are configured to discharge the cooling fluid from the tip shroud portion via the tangential surface.

16. The turbine of claim 15, wherein the tangential surface comprises a top surface of the seal rail extending between the tangential ends, the top surface is the most radially outward surface of the seal rail relative to the rotational axis of the rotor, and the first plurality of cooling outlet passages are configured to discharge the cooling fluid from the top surface to reduce over tip leakage between the top surface and an innermost surface of a stationary shroud disposed radially across from the top surface.

17. The turbine of claim 16, wherein the plurality of cooling outlet passages are angled relative to the length of the seal rail at an angle greater than 0 degree and less than 180 degrees.

18. The turbine of claim 15, wherein the tangential surface comprises a first side surface or a second side surface of the seal rail extending between the tangential ends of the seal rail and extending radially between a top surface of the seal rail and the base portion, and the first side surface is disposed opposite the second side surface.

19. The turbine of claim 18, wherein the plurality of cooling outlet passages extends between the cooling plenum and both the first and second side surfaces.

20. A turbine blade, comprising:

a tip shroud portion having a base portion and a seal rail extending radially from the base portion, wherein the seal rail comprises a tangential surface extending between tangential ends;

a root portion configured to couple to a rotor of a turbine; and an airfoil portion radially extending between the root portion and the tip shroud portion; and wherein the airfoil portion comprises a cooling plenum extending radially through the airfoil portion and configured to receive a cooling fluid, and the cooling plenum is axially offset from the seal rail relative to a rotational axis of the rotor, wherein the seal rail comprises a cooling passage extending along a length of the seal rail, the cooling passage is fluidly coupled to the cooling plenum to receive the cooling fluid via an intermediate cooling passage extending between the cooling passage and the cooling plenum, and wherein the seal rail comprises a plurality of cooling outlet passages fluidly coupled to the cooling passage to receive the cooling fluid, the plurality of cooling outlet passages being disposed within the seal rail and extending between the cooling passage and the tangential surface of the seal rail, and the plurality of cooling outlet passages are configured to discharge the cooling fluid from the tip shroud portion via the tangential surface.

* * * * *